US005537926A

United States Patent [19]

Beisel et al.

[11] Patent Number: 5,537,926

[45] Date of Patent: Jul. 23, 1996

[54] PRINTING-PLATE MAGAZINE FOR PRINTING MACHINE

[75] Inventors: Hermann Beisel, Walldorf; Peter T. Blaser, Dielheim; Dieter Hauck, Eberbach; Rudolf Hutzenlaub, Mannheim; Helmut Jäger, Königsbach-Stein; Hans-Georg Jahn, Wiesenbach; Robert Müller, Mörlenbach; Anton Rodi, Leimen; Nikolaus Spiegel, Walldorf, all of Germany

[73] Assignee: Heidelberger Druckmaschinen AG, Heidelberg, Germany

[21] Appl. No.: 211,102

[22] PCT Filed: Sep. 7, 1992

[86] PCT No.: PCT/EP92/02063

§ 371 Date: May 12, 1994

§ 102(e) Date: May 12, 1994

[87] PCT Pub. No.: WO93/04865

PCT Pub. Date: Mar. 18, 1993

[30] Foreign Application Priority Data

Sep. 12, 1991 [DE] Germany ..... 41 30 359.8

[51] Int. Cl.[6] ..... B41F 27/06

[52] U.S. Cl. ..... 101/477; 101/415.1; 101/485

[58] Field of Search ..... 101/216, 415.1, 101/477, 480, 485, 486, 378, DIG. 36

[56] References Cited

U.S. PATENT DOCUMENTS

| | | | |
|---|---|---|---|
| 4,191,105 | 3/1980 | Ohlsson | 101/415.1 |
| 4,727,807 | 3/1988 | Suzuki et al. | 101/415.1 |
| 4,936,212 | 6/1990 | Moss | 101/415.1 |
| 5,111,744 | 5/1992 | Wieland | 101/216 |
| 5,218,907 | 6/1993 | Komori et al. | 101/415.1 |
| 5,299,498 | 4/1994 | Spiegel et al. | 101/477 |
| 5,309,832 | 5/1994 | Merkel et al. | 101/415.1 |

FOREIGN PATENT DOCUMENTS

| | | |
|---|---|---|
| 0432660 | 6/1991 | European Pat. Off. . |
| 0435413 | 7/1991 | European Pat. Off. . |
| 0435410 | 7/1991 | European Pat. Off. . |
| 61-248834 | 11/1986 | Japan . |

OTHER PUBLICATIONS

Japanese Patent Abstract No. 61–248834 (Shinichi), dated Nov. 6, 1986.

*Primary Examiner*—Stephen Funk
*Attorney, Agent, or Firm*—Herbert L. Lerner; Laurence A. Greenberg

[57] ABSTRACT

A device designed as a magazine is disclosed for carrying away and/or supplying printing plates from and to a plate cylinder of a printing machine, in particular to ensure the automatic exchange of printing plates with a plate removing and a plate supplying arrangement. At least one cartridge for the printing plates is removably associated with the magazine. A corresponding process is also disclosed.

8 Claims, 16 Drawing Sheets

Fig. 7
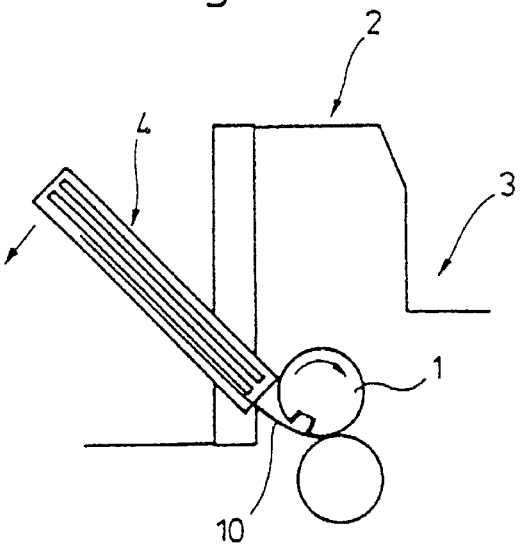
Fig. 8
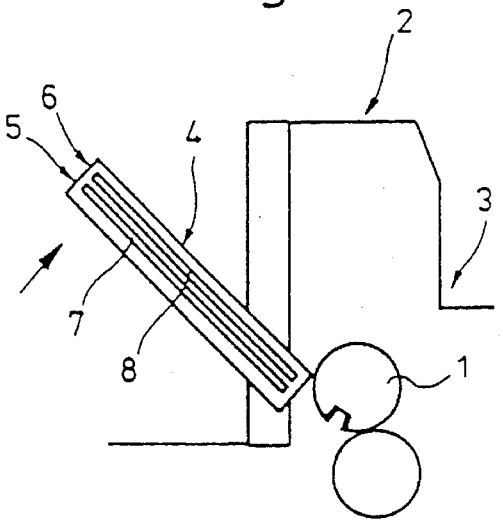
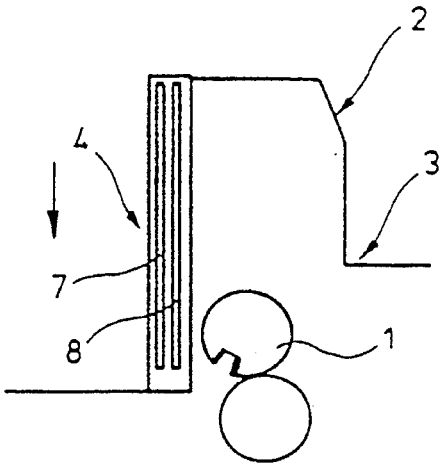
Fig. 9

PRINTING-PLATE MAGAZINE FOR PRINTING MACHINE

BACKGROUND OF THE INVENTION

1. Field of the Invention

The invention relates to a device, in the form of a magazine, for removing and/or supplying printing plates from or to a plate cylinder of a printing press, in particular for the automatic or semi-automatic changing of printing plates, with a plate-removing apparatus and a plate-supplying apparatus.

A device of the initially mentioned kind is known from European patent application 0 435 410. The purpose of said device is to automate the changing of printing plates.

The magazine holds old, used plates. For removal, the used printing plate is released from the plate cylinder at one end and is then—through appropriate rotation of the plate cylinder—partially inserted into the magazine. Subsequently, the other end of the printing plate is released by the tensioning device of the plate cylinder and the entire printing plate is introduced into the magazine with the plate-removing apparatus. Subsequently, a new printing plate to be used is taken from the magazine by means of the plate-supplying apparatus. First, one end of the printing plate is inserted into the corresponding clamping device of the plate cylinder, where it is clamped, and then—through rotation of the plate cylinder—the printing plate is removed completely from the magazine and is drawn around the outer cylindrical surface of the plate cylinder. Then, the other end of the printing plate is clamped and the plate is tensioned in the circumferential direction.

If the printing press comprises a plurality of printing units, a magazine is associated with each printing unit. For the removal and/or supply of printing plates, it is necessary for the magazine to be brought from a more or less vertical position into an obliquely inclined position in which the lower end of the magazine is opposite the outer cylindrical surface of the plate cylinder. Since the space between the individual printing units is tight on virtually all printing presses, only little space is available for the magazines. Consequently, the removal of old, used printing plates from-the magazine and/or the introduction of new, yet to be used printing plates into the magazine is associated with corresponding difficulties.

SUMMARY OF THE INVENTION

The object of the invention is to create a device of the initially mentioned kind, said device, while being of simple construction, reliable operation and small design, permitting the removal and/or supply of printing plates and also allowing printing plates to be introduced into and removed from the magazine in simple manner.

The object of the invention is achieved in that at least one cassette for the printing plates is removably associated with the magazine. This has the advantage that the new, yet to be used printing plates can be introduced into the cassette outside of the magazine, with the result that, in order to "load" the magazine, it is merely necessary to introduce the cassette into the magazine. In similar manner, the simple removal of old, used printing plates from the magazine is possible in that the used printing plates are introduced by means of the plate-removing apparatus into the cassette in the magazine, with the result that, for removal, it is merely necessary to remove the cassette, filled with used printing plates, from the magazine. The device according to the invention is suitable either for the removal of old, used printing plates or for the supply of new, yet to be used printing plates or, alternatively, also for the removal and supply of printing plates; that is, there is then a change of printing plates in which a used printing plate is accepted and a yet to be used printing plate is supplied from the magazine.

If the cassette both accepts used printing plates and also delivers yet to be used printing plates, it comprises a holding space for the used printing plates and a holding space for the yet to be used printing plates. To commence operation of the printing press, it is then merely necessary for this one cassette to be associated with the corresponding printing unit.

Alternatively, however, it is also possible for two cassettes to be removably associated with the magazine, of which cassettes a first cassette serves to accept used printing plates and a second cassette serves to deliver yet to be used printing plates. Consequently, for operation, two cassettes must be associated with each printing unit of the printing press.

The association of the cassette or cassettes is particularly simple if the magazine comprises at least one holding shaft for insertion of the cassette or cassettes. If two cassettes must be associated with the magazine, preferably two holding shafts are provided on the magazine.

Moreover, it is advantageous to employ a pressing-down device, said pressing-down device engaging the yet to be used printing plates remaining in the cassette transversely with respect to the planes thereof, in order to prevent their tipping out from the cassettes. Otherwise, such tipping-out might occur particularly when, after an automatic plate change has been performed, the magazine is swiveled back into its vertical position.

Preferably, at least the cassette holding the used (old) printing plates comprises a base with adjoining, U-shaped upper and lower edge regions. Preferably, the U-shaped leg of the upper edge region, forming a holding edge, is longer than the corresponding U-shaped leg of the lower edge region. This makes it possible for the rear edge of a used printing plate first of all to be pushed far under the longer U-shaped leg of the upper edge region and then be pulled back, with the result that the front edge also comes under the corresponding U-shaped leg of the lower edge region, without the rear edge of the printing plate being released by the longer U-shaped leg in the upper edge region. Preferably, the cassette for the new printing plates is of the same design as the cassette for the old printing plates.

It has already been explained hereinbefore that the lifting of a new printing plate from the pile of printing plates inside the cassette is effected not simultaneously over the whole surface area, but is staggered in such a manner that air is able to get between the plates, in order to prevent the printing plates from "sticking together". For example, suction-gripping by the rear, upper row of suckers may be effected first, followed by the middle row and finally by the lower row of suction elements. Moreover, it may preferably be provided that the cassette holding the printing plates to be used comprises spacers, said spacers being disposed between adjacent printing plates. Said spacers prevent a vacuum from forming between the individual printing plates. They may be in the form of plastic tabs. Preferably, they are adapted to be fixed on the cassette in the locking seat. Consequently, when a cassette is being filled, a spacer (or a plurality of spacers) is first clipped into the cassette in such a manner that it is disposed on the surface of an inserted printing plate. Only then is a further new printing plate inserted into the cassette. The spacers are so flexible that they yield when a below-lying printing plate is removed.

Moreover, it is particularly advantageous if the individual cassettes each comprise a marking, particularly a color marking, which relates to the associated printing unit, particularly to the color of the ink to be printed with the printing unit. If all the cassettes for the individual printing units have been furnished with printing plates outside of the printing press, they can, on the basis of said marking, be inserted in particularly simple manner into the magazines of the individual printing units without there being any confusion.

The magazine according to the invention is preferably of layered construction, with the cassette holding the used printing plates being disposed in a lower layer and with the plate-removing apparatus associated with the aforementioned cassette being disposed in a following layer and with the cassette holding the yet to be used printing plates being disposed in a further following layer and with the plate-supplying apparatus associated with the aforementioned cassette being disposed in a following, outer layer.

The invention relates further to a process for removing and/or supplying printing plates from or to a plate cylinder of a printing press with a plurality of printing units, in particular for the changing of printing plates, wherein individual part-actions, such as, in particular, unclamping of the printing-plate rear edges and/or unclamping of the printing-plate front edges and/or removing of the used printing plates and/or supplying of the yet to be used printing plates and/or clamping of the printing-plate front edges and/or pressing-down and clamping of the printing-plate rear edges, are effected consecutively, i.e. one after the other, as a function of the smallest positioning travel of the individual plate cylinders on the corresponding printing units before the next part-action is performed in similar manner. Consequently, according to the invention, the removal, supplying or changing of printing plates is not performed in full on one printing unit of the printing press before then being effected on the next printing unit of the printing press, but the individual—preferably automatic—working steps (part-actions) are carried out consecutively on the corresponding printing units, with the printing-unit sequence in the performance of said part-actions being determined by the criterion of the smallest positioning travel of the plate cylinders. This makes it possible for printing plates to be removed or supplied or changed in an extremely short time on all printing units. Preferably, a start is made with the first-required part-action on that printing unit whose plate cylinder needs to be moved by the smallest positioning travel out of the current angular position in order to attain the angular position necessary for performance of the part-action.

In the case of fully automatic operation, the operator may, preferably from a control desk, trigger the fully automatic changing of printing plates or the fully automatic unclamping of a used printing plate or the fully automatic clamping of a new printing plate. For this purpose, it is necessary first of all to select a command which defines the required operation. Subsequently, the fully automatic operation is then started by the operator (by pressing a button). The part-actions to be performed then take place according to the aforementioned principle of optimization.

In addition to said fully automatic operation, however, a semi-automatic operating mode is also conceivable. This is likewise carried out with a minimum number of actions on the part of the operator and is intended at the same time to involve the minimum potential for operator errors. The operator merely uses control elements in order to control the process relating to the changing of printing plates or the supply or removal of printing plates; that is, the operator need not handle the printing plates himself even in the case of semi-automatic operation.

In order, in semi-automatic operating mode, to render operation as easy-to-follow and error-free as possible, the invention provides for only a few control elements, with which, however, different functions can be executed. Consequently, for example, a control element in the form of a button permits, when pressed, the performance of different part-actions (for example, the clamping of the printing plate or the unclamping of the printing plate or, alternatively, various positioning operations of the respective plate cylinder). For this purpose, the performance of individual part-actions is stored in such a manner that the repeat actuation of a control element that triggered the previous part-action triggers another, different part-action when actuated again. This provides maximum operational reliability with a minimum of control elements.

The invention is illustrated on the basis of a specimen embodiment with respect to the drawings.

BRIEF DESCRIPTION OF THE DRAWINGS

FIG. 7 shows the magazine in the plate-changing position during acceptance of the used printing plate;

FIG. 8 shows a representation according to FIG. 7, with, however, the printing plate already being completely in a cassette of the magazine;

FIG. 9 shows the magazine once again in the starting position;

DESCRIPTION OF THE PREFERRED EMBODIMENT

Figure 1:
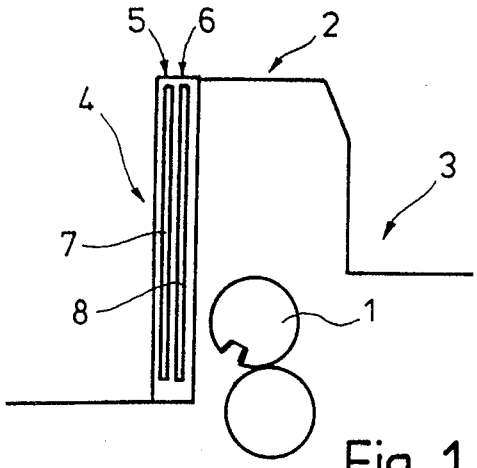
FIG. 1 shows a printing unit of a printing press in a schematic representation with a magazine in the starting position.

In order to provide for automatic or semi-automatic changing of printing plates—that is, to remove an old, used printing plate and then to supply a new printing plate to be used to the plate cylinder 1 of a printing unit 2 of a printing press 3—the printing unit 2 comprises a device in the form of a magazine 4. The magazine 4, which, in the case of a printing press 3 with a plurality of printing units 2, is provided on each printing unit 2 of the printing press 3, may also be used merely to supply a new printing plate to be used or merely to remove an already used printing plate (FIG. 1 to 9).

In FIG. 1, the magazine 4 is in its starting position (vertical position). In this idle position, the magazine 4 is secured (locked) against tilting. Normal printing-press operation (printing mode) is possible only with the magazine 4 in this lower, vertical position.

The magazine 4 comprises two holding shafts or receiving chutes 5 and 6, into which cassettes 7 and 8, respectively, are insertable from above (FIG. 1). The cassette 7 is used to hold old printing plates which have already been used in the printing press 3. The cassette 7 is of such design that it is capable of holding a plurality of, for example five, used printing plates. Said printing plates form a printing-plate pile inside the cassette 7; that is, the individual printing plates are in flat contact with one another. The cassette 8 is used to hold new printing plates that are yet to be used. It, too, is capable of holding a plurality of, particularly five, printing plates simultaneously, with, once again, said printing plates being in flat association with one another. In order to remove the used printing plates, it is thus merely necessary to withdraw the cassette 7 out of the holding shaft 5. Once outside of the printing press 3, the cassette 8 can be furnished with new printing plates yet to be used. Once this has been done, the cassette 8 is inserted into the holding shaft 6 of the magazine 4, with the result that it is available for supplying the plate cylinder 1 of the corresponding printing unit 2.

Figure 2:
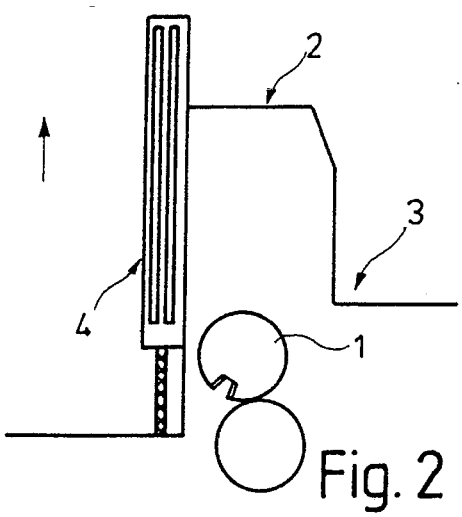
FIG. 2 shows the magazine from FIG. 1 in a center position.
Figure 3:
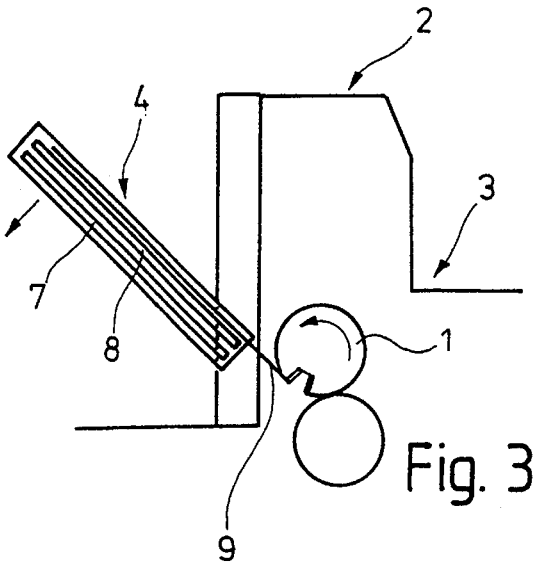
FIG. 3 shows the magazine in the plate-changing position while a new printing plate to be used is supplied to the plate cylinder of the printing press.
Figure 4:
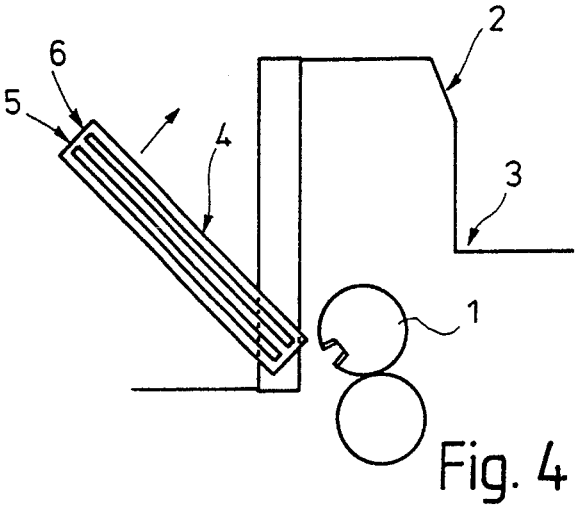
FIG. 4 shows a representation according to FIG. 3, with, however, the printing plate already having been clamped onto the plate cylinder.
Figure 5:
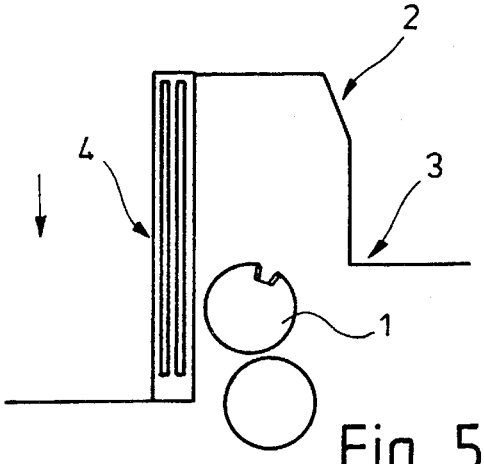
FIG. 5 shows the return of the magazine into the starting position.

Described hereinbelow are the individual positions of the magazine 4 which are assumed for the removal and/or supply of printing plates. If the plate cylinder 1 is to be supplied with a new printing plate 9, the magazine 4 moves—as shown in FIG. 2—vertically upwards into a center position and then—as shown in FIG. 3—swivels into an oblique position (approximately 45°, for example). By means of a plate-supplying apparatus (still to be described in greater detail) of the magazine 4, the printing plate 9 to be used is then supplied to the plate cylinder 1 and is clamped thereon (FIG. 4). Subsequently, the magazine 1 then swivels back into its vertical position and is then lowered again into the lower position (starting position) as shown in FIG. 5.

Figure 6:
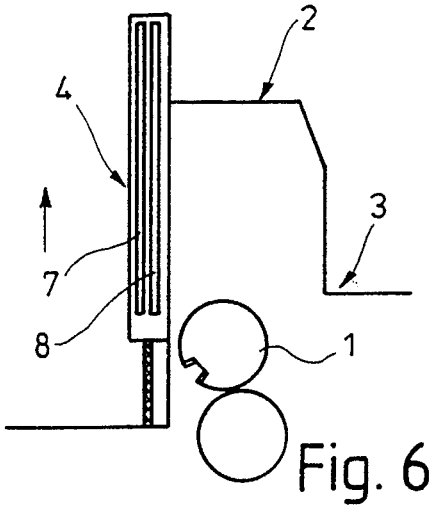
FIG. 6 shows the movement to the center position in order to accept a used printing plate.

The printing process can now be carried out. When the printing job has been performed, the printing plate 9 must be removed from the plate cylinder 1. For this purpose, a lifting device, in turn, lifts the magazine 4 into the center position (FIG. 6). Subsequently, as shown in FIG. 7, the magazine 4 is swiveled into the oblique position and—through releasing of the plate rear edge and backward rotation of the plate cylinder 1 —the used printing plate 10 is partially inserted into the magazine 4 (FIG. 7). As shown in FIG. 8, the used printing plate 10 is then pulled completely into the cassette 7 by a plate-removing apparatus (still to be described in greater detail) of the magazine 4. Next, the magazine 4 is again swiveled into its vertical position and then—as shown in FIG. 9—is lowered into the starting position.

Of course, it is also possible to combine the removal and supply of printing plates in order to effect the changing of printing plates. This means that, in the oblique position, a used printing plate 10 is first accepted by the magazine 4 and a new printing plate is then supplied to the plate cylinder 1. Once this has been done, the magazine 4 swivels back into the vertical and is lowered into the starting position.

Hereinbelow, the design of the magazine 4 is to be described in greater detail with reference to FIG. 10 to 12.

Figure 10:
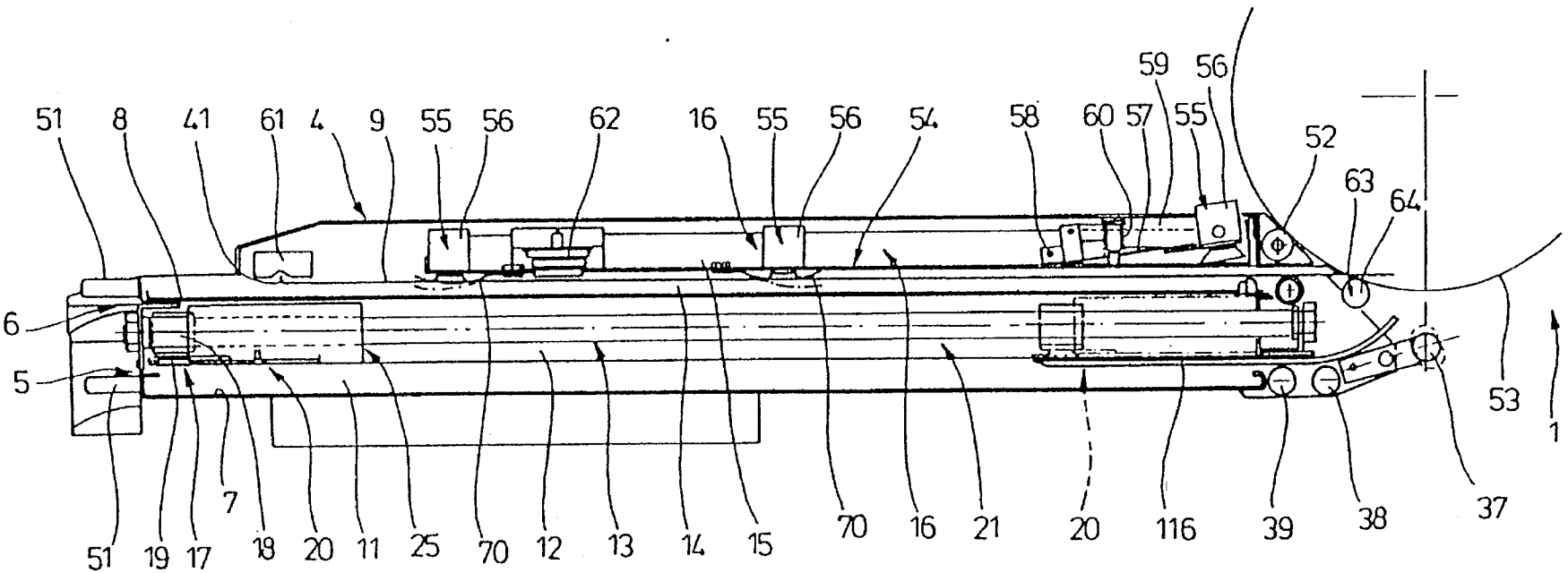
FIG. 10 shows a longitudinal section through the magazine.
Figure 11:
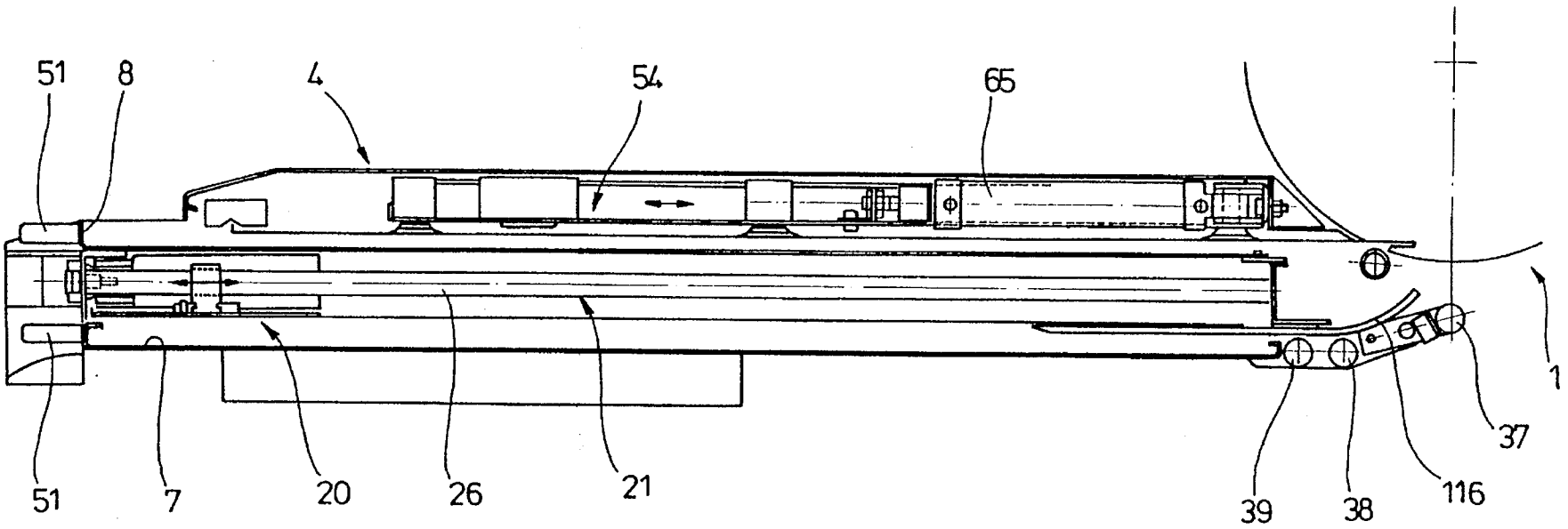
FIG. 11 shows a longitudinal section through the magazine according to FIG. 10, but in a different plane.
Figure 12:
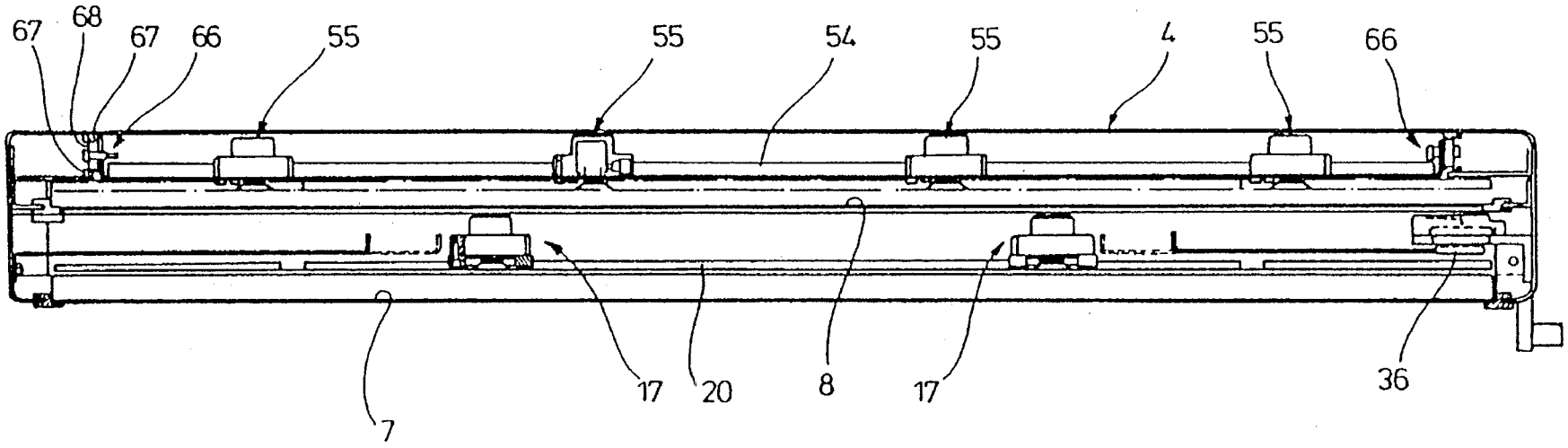
FIG. 12 shows a cross section through the magazine.

For graphical reasons, the magazine 4 is shown in FIG. 10 and 11 in a horizontal position in relation to the side edges of the drawing sheet. It should, however, be pointed out that the positions shown in FIG. 10 and 11 correspond to the oblique positions shown in FIG. 3, 4, 7 and 8.

The magazine 4 is of layered construction. It comprises an outer layer 11, which holds the cassette 7. Accommodated in a following layer 12 is a plate-removing apparatus 13, which is associated with the aforementioned cassette 7. The cassette 8 is disposed in a following layer 14.

A further following layer 15 holds a plate-supplying apparatus 16, which cooperates with the printing plates 9 of the cassette 8.

Figure 17:
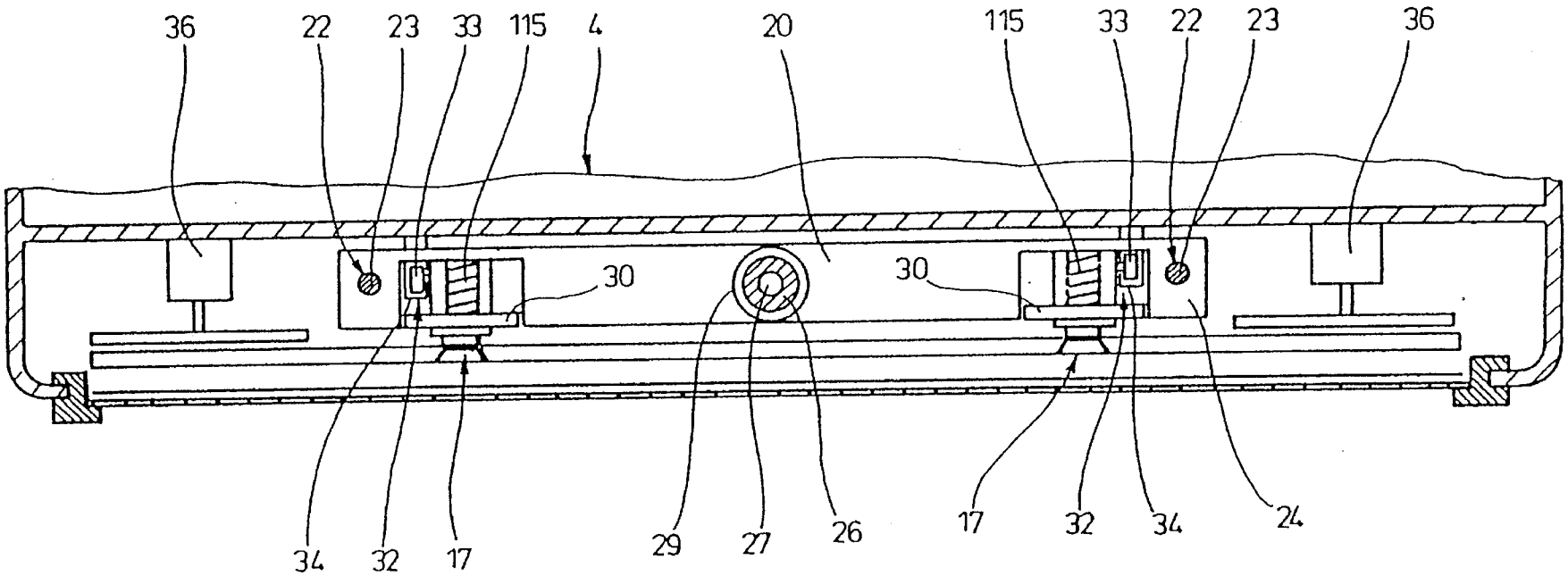
FIG. 17 shows a cross section through the magazine in the region of a plate-removing apparatus.

The plate-removing apparatus 13 comprises first holding means 17, which are in the form of activatable first suction elements 18. The suction pads 19 of the first suction elements 18 can be extended towards the printing plates 10 (for the sake of clarity, only one printing plate 9/10 is shown in each of FIG. 10 and 11). The first suction elements 18 are disposed on a first carriage 20, which is adapted to be moved along a first guide 21. As shown in FIG. 17, the guide 21 comprises two spaced-apart, parallel-extending guide parts 22, which are in the form of guide rods 23. The guide rods 23 are encompassed with little play by guide parts 24 of the first carriage 20.

The first carriage 20 is adapted to be moved along the first guide 21 by means of a driving apparatus 25. The driving apparatus 25 comprises a fixed, non-ferromagnetic tube 26 (an aluminium tube, for example), which extends from the top side to the bottom side of the magazine 4. Situated inside the tube 26 is a magnetic piston 27, which is adapted to be moved backwards and forwards inside the tube 26 by means of a pressure medium in addition to being positionable in desired positions. Situated on the first carriage 20 is a ferromagnetic component which is in the form of a steel ring 29. Consequently, a movement of the magnetic piston 27 has the effect that the steel ring 29 and therefore the carriage 20 are moved through the intermediary of the magnetic field. Such a design provides a flexible coupling and, moreover, the carriage is movable from a position at the extreme top in the magazine 4 (shown by solid lines in FIG. 10) into a position at the extreme bottom (shown by broken lines in FIG. 10).

As shown in FIG. 17, a suction element 18 is disposed on either side of the driving apparatus 25. Each suction element 18 is attached to a lever 30, which is adapted to be swiveled towards the printing plate 10 by means of a hinge 31. The position of the levers 30 is determined by a forced-control device 32 (see also FIG. 13), which is formed by a roller 33 connected to each lever 30, said roller 33 running in a location-fixed guide rail 34. Each guide rail 34 comprises in the upper region of the magazine 4 a bevelled section 35 (FIG. 13), with the result that, with the carriage 20 moving into an upper position, the rollers 33 contact the bevelled sections 35 and thereby swivel the levers 30 and thus the suction elements 18 towards the printing plate 10. Springs 115 serve to return the lever 30 and to make the rollers 33 contact the bevelled sections 35.

Disposed on opposite sides in the lower region of the magazine 4 are actuatable holders-down 36, which serve to engage the printing plate 10 in said region. Furthermore, guide rollers 37, 38 and 39 are disposed in the lower region of the magazine 4.

Figure 13:
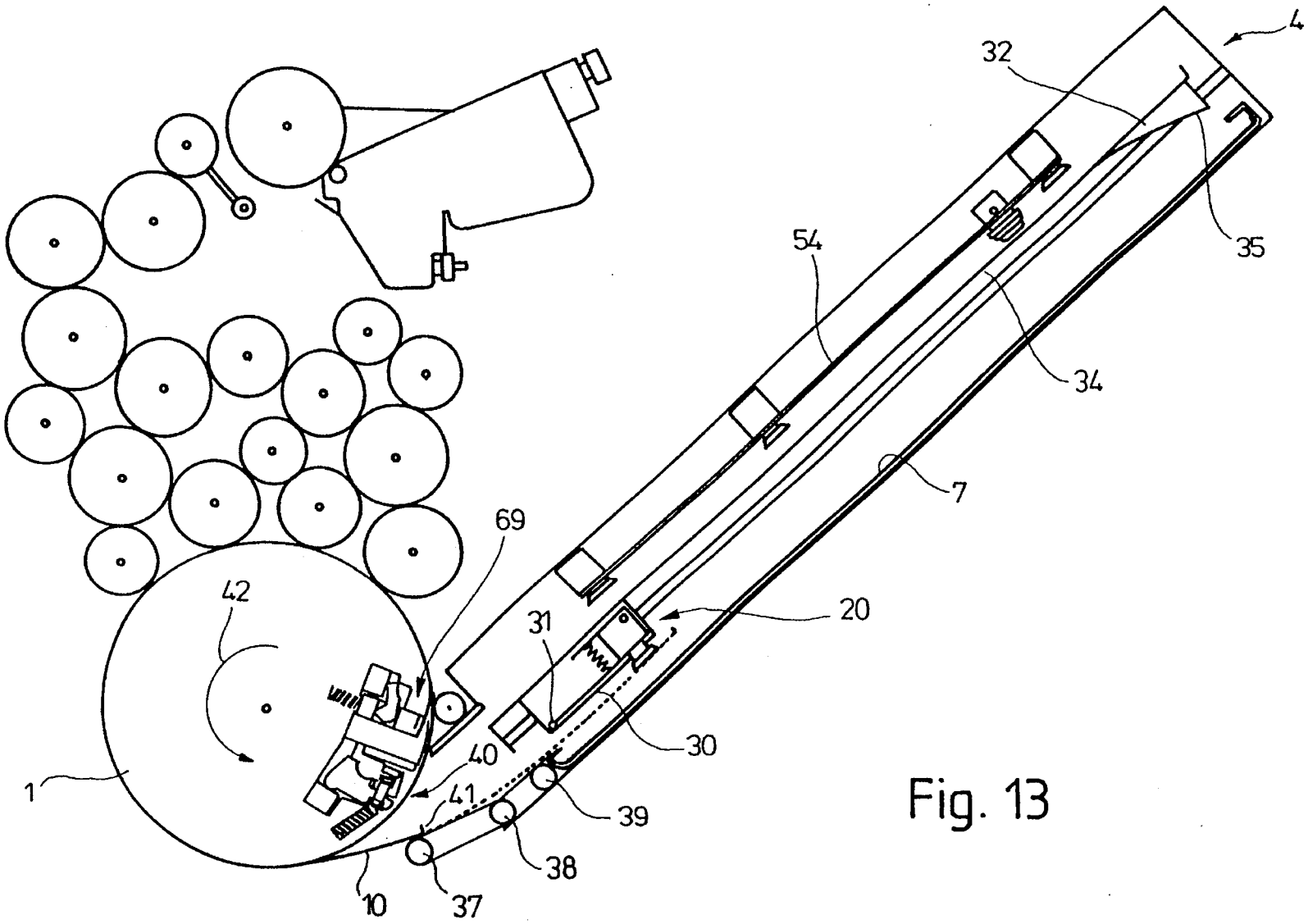
FIG. 13 shows a schematic view in the longitudinal section during the supply of a used printing plate to the magazine.
Figure 14:
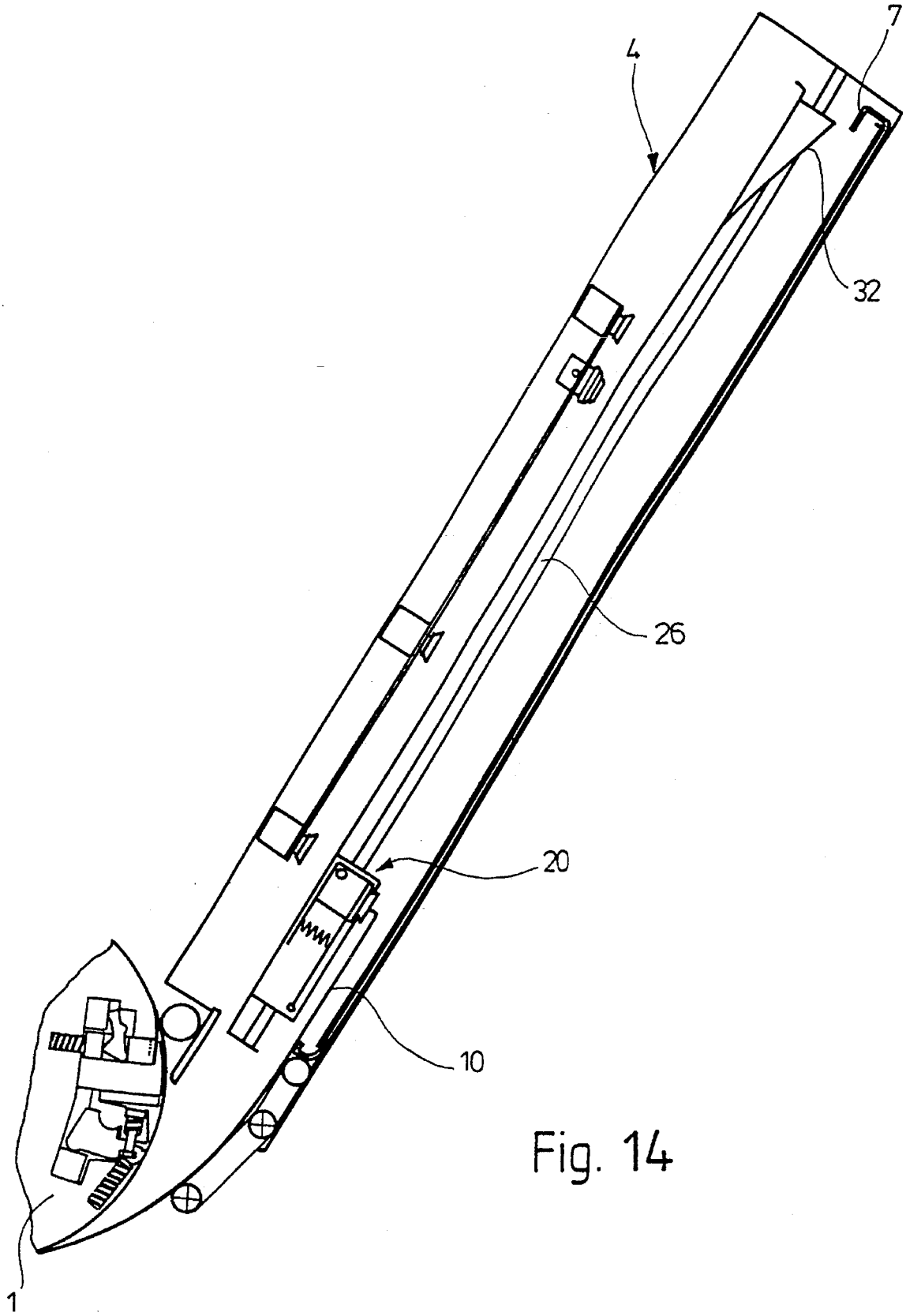
FIG. 14 shows a representation according to FIG. 13, but with the printing plate introduced further.
Figure 15:
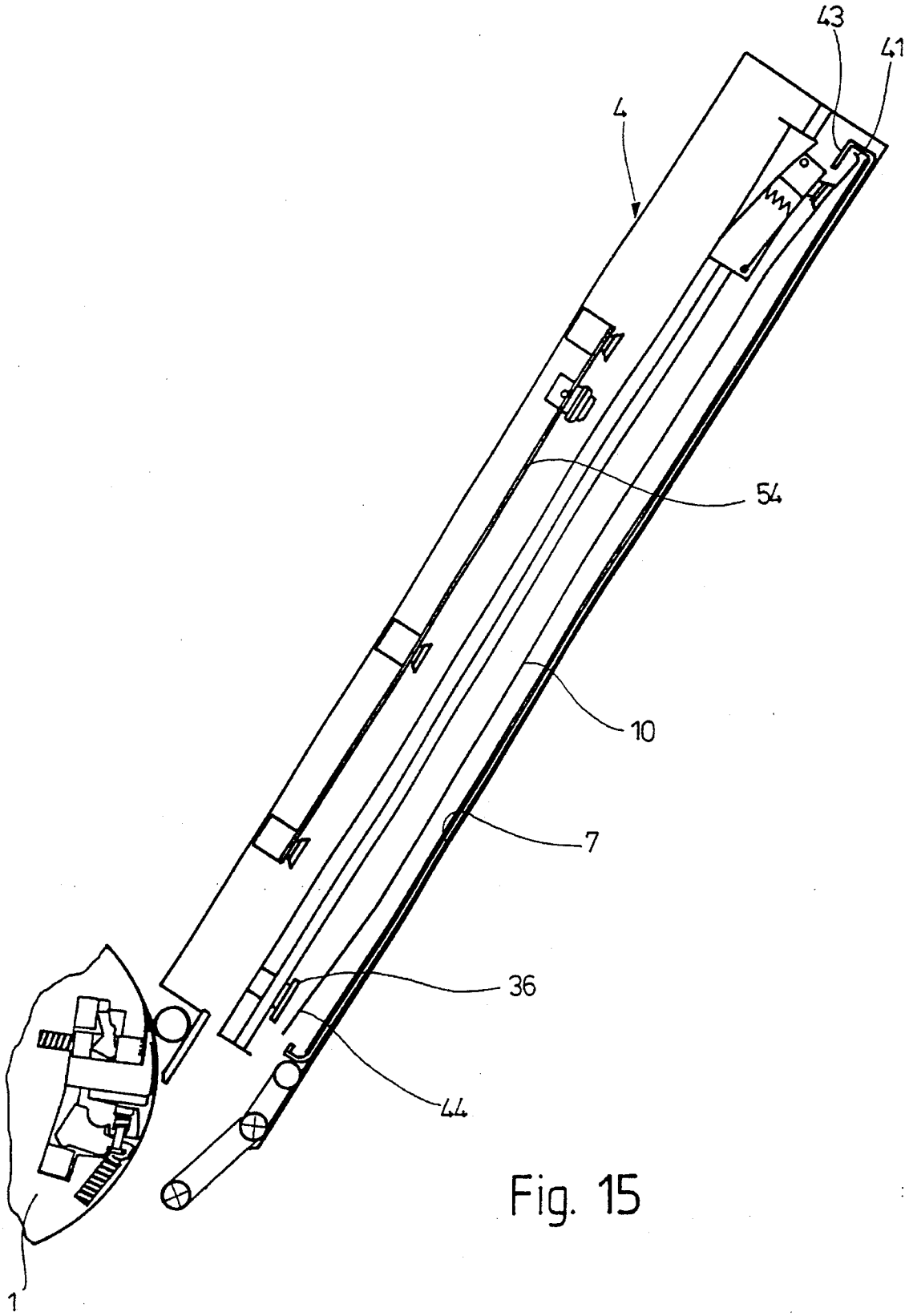
FIG. 15 shows the magazine in the longitudinal section with the printing plate completely introduced.
Figure 16:
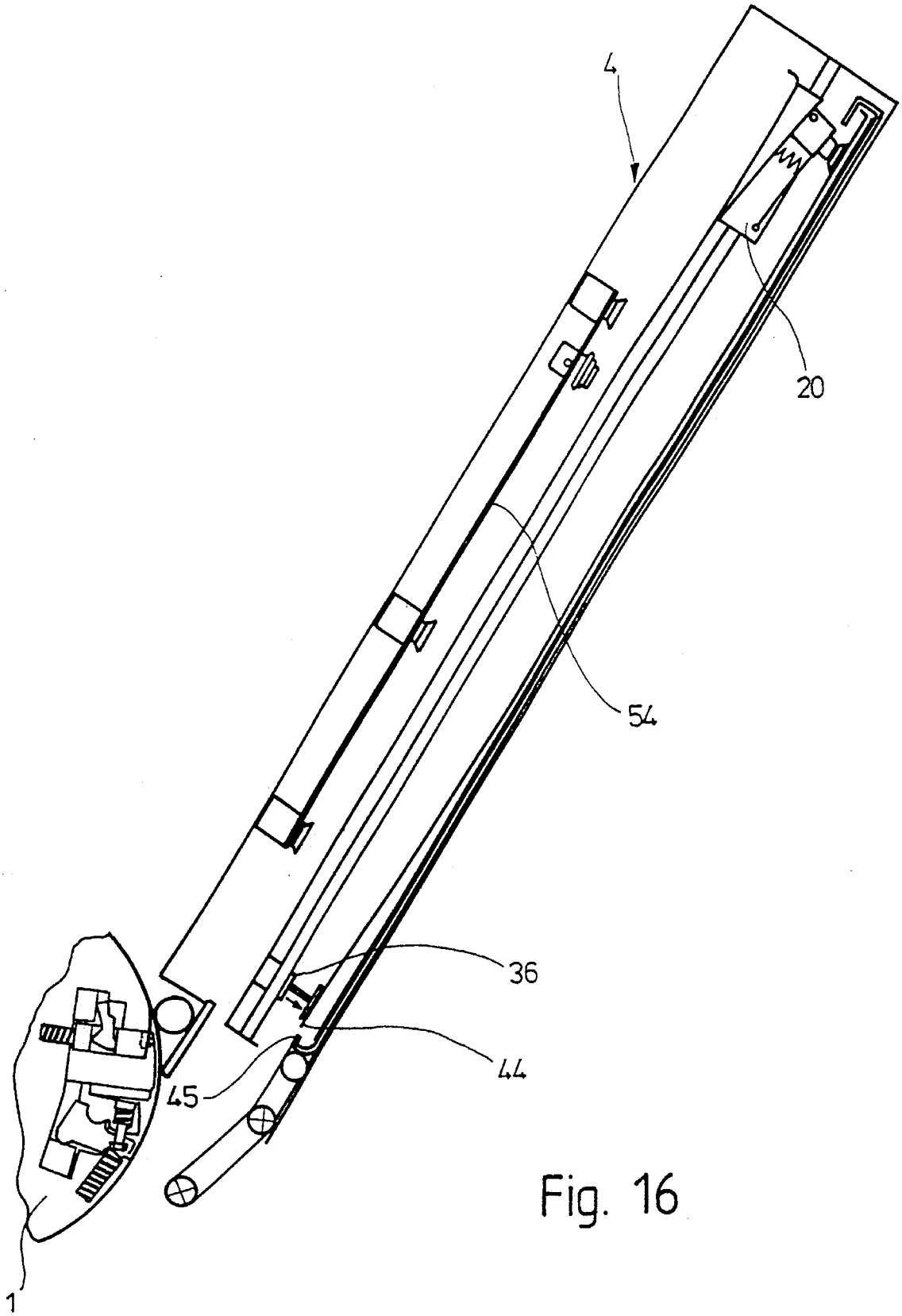
FIG. 16 shows a representation according to FIG. 15, but with the front edge of the printing plate being introduced into a cassette of the magazine.

Hereinbelow, there is a functional description of the removal of a used printing plate 10 from the plate cylinder 1 into the cassette 7 of the magazine 4. For this purpose, first of all, the magazine 4 is—as shown in FIG. 6 and 7—brought into the required oblique position. Subsequently, a rear-edge clamping device 40 of the plate cylinder 1 opens and releases the there-clamped, angled printing-plate rear edge 41. Owing to the inherent elasticity, the rear end of the printing plate 10 consequently strikes against the guide roller 37 (FIG. 13). Subsequently, through backward rotation (arrow 42) of the plate cylinder 1, the printing plate 10 is inserted into the cassette 7 of the magazine 4. The guide rollers 37, 38 and 39 assist with the introduction of the rear-edge end of the printing plate 10. Guide rails 116 may be provided, said guide rails 116 sliding in cutouts of the printing-plate rear edge 41. Said introduction is shown by a dotted line in FIG. 13 and by an unbroken line in FIG. 14. When approximately one-third of the printing plate 10 has been inserted into the magazine 4, the suction elements 18 of the carriage 20 (the carriage 20 being in the lowermost position inside the magazine 4) are activated; that is, the suction pads 19 move towards the printing plate 10 to be held and firmly adhere by suction to the printing plate 10. Next, with simultaneous further backward rotation of the plate cylinder 1, the carriage 20 moves into its upper position, as a result of which the printing plate 10 is pulled completely into the magazine 4, with the front edge 44 of the printing plate 10 also being unclamped. When the carriage 20 enters the upper end region of the magazine 4, the rollers 33 contact the bevelled sections 35 and swivel the levers 30, with the result that—as shown in FIG. 15—the angled printing-plate rear edge 41 comes under a holding edge 43 of the cassette 7. Subsequently, the holders-down 36 press down the printing plate 10 in the region of its front edge 44 (FIG. 16), with the result that the front edge 44 comes to lie at a lower position than a holding edge 45 of the cassette 7. Through the force of gravity and/or through movement of the carriage 20, the front edge 44 is then brought under the holding edge 45 through pulling-down of the printing plate 10. Consequently, the printing plate 10 is safely disposed in the cassette 7. Particularly if a plurality of already used printing plates 10 are to be accommodated in the cassette 7, it is necessary for the last-inserted printing plates 10 to be pulled down by means of the carriage 20 and to be held by the holders-down 36, so that they come under the holding edge 45, since, owing to relatively great stresses at the start of the printing plate, the force of gravity alone is no longer sufficient to move the printing plates 10 into said position.

The removal of the used printing plates 10 from the magazine 4 is accomplished ill simple manner in that the cassette 7 is withdrawn from the associated holding shaft 5.

Figure 18:
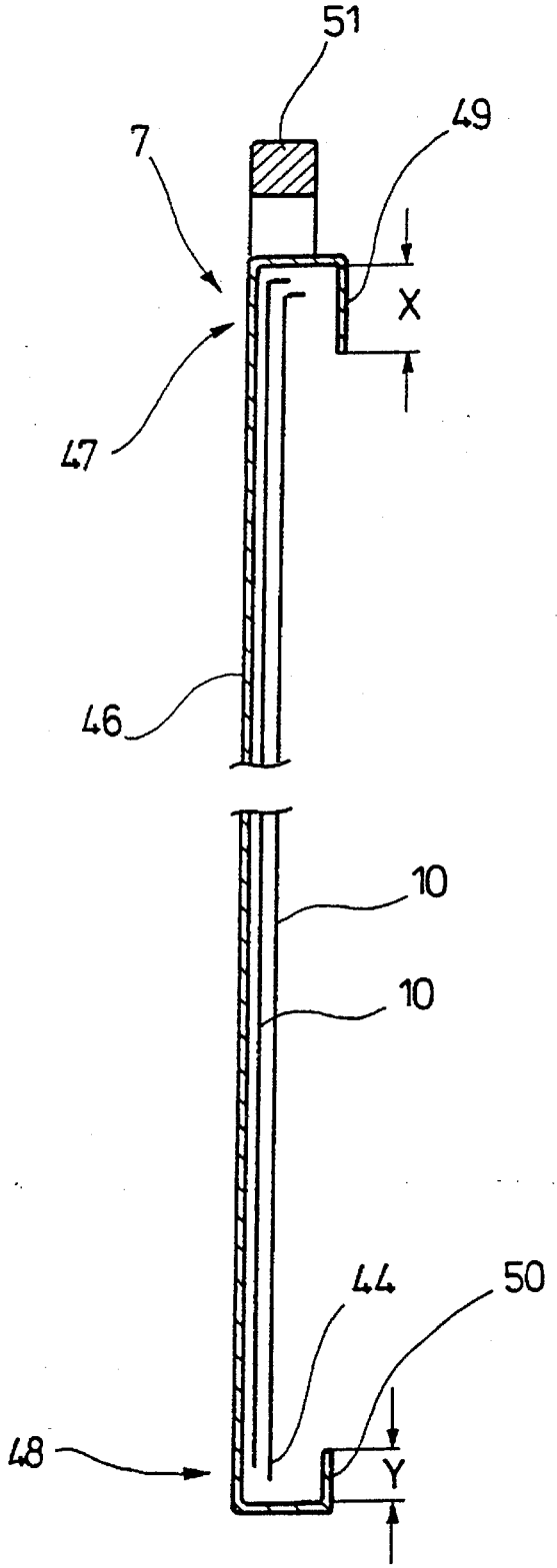
FIG. 18 shows a longitudinal section through the cassette.

FIG. 18 shows a longitudinal section through a cassette 7. The cassette 7 comprises a base 46, which is adjoined by U-shaped upper and lower edge regions 47, 48. The upper edge region 47 comprises a U-shaped leg 49 and the lower edge region 48 comprises a U-shaped leg 50, which forms the holding edge 45. The length x of the U-shaped leg 49 is greater than the length y of the U-shaped leg 50. The clear distance between the ends of the U-shaped legs 49 and 50 is selected such that a printing plate 10 to be inserted is first slid under the U-shaped leg 49 and is then swung into the interior of the cassette 7, with the front edge 44 passing the U-shaped leg 50. Subsequently, the printing plate 10 is then displaced in such a manner that its front edge 44 passes under the U-shaped leg 50, without, however, the locating action of the U-shaped leg 49 being lost—thanks to the greater length of the U-shaped leg 49. Consequently, the printing plate 10 is safely accommodated inside the cassette 7. The procedure is similar when removing a printing plate 9 from a cassette 8, insofar as use is made also of a cassette with locating edges.

Each cassette 7 or 8 comprises in its upper region a handle 51 in order to facilitate insertion and removal from the respective holding shaft 5 or 6 of the magazine 4. In addition, the handle 51 also makes it easier for the corresponding cassette 7 or 8 to be transported to the printing press. Furthermore, each cassette 7 or 8 is provided with a marking, particularly a color marking (this may be disposed, for example, on the handle 51), said marking relating to the respective printing unit 2 of the printing press 3. For example, the handle 51 may be of a color corresponding to the printing ink of the respective printing unit 2. Unambiguous identification is made possible in this manner.

Reference may be made already at this point to a special feature of the cassette 8 containing the new printing plates 9 yet to be used, although the removal of the printing plates 9 from the cassette 8 will be discussed at a later point hereinbelow. If there is a plurality of printing plates 9 piled one on top of the other inside the cassette 8, then it is possible, when the uppermost printing plate 9 is removed, for a vacuum to be formed with respect to the following printing plate 9. This may result in two printing plates being removed simultaneously by mistake owing to the fact that they "stick together". To prevent this, a special removal technique is implemented and will be discussed in greater detail hereinbelow; moreover, it is possible to provide spacers between the individual printing plates 9, with the result that the formation of a vacuum is prevented. The spacers are preferably in the form of plastic tabs. These can be clipped preferably into locking seats ill the edge regions. An advantageous further development of the invention provides that the spacers are in the form of two rows of individual tabs, with, when the printing plates are being inserted, a tab being placed between every two printing plates on both sides. It is advantageous for said tabs to be disposed in the region of the front row of suckers, which goes into action first. Consequently, when a cassette 8 is being furnished with printing plates, spacers are first of all clipped in position before a further printing plate 9 is laid on a printing plate 9 already in the cassette 8. The spacers are so flexible that they yield when the printing plate below is removed.

If, after the removal of a printing plate 10, a new, as yet unused printing plate 9 is to be clamped immediately onto the plate cylinder 1, then the magazine 4 remains in its oblique position and a new printing plate 9 is taken from the cassette 8. This is accomplished by means of the plate-supplying apparatus 16.

In order for a printing plate 9 from the cassette 8 to be supplied to the plate cylinder 1 by means of the plate-supplying apparatus 16, the magazine 4 is—as mentioned hereinbefore—in its oblique position in which support rollers 52 are supported on cylinder bearers 53 associated with the plate cylinder 1. The plate-supplying apparatus 16 comprises on a second carriage 54 second holding means 55, which are likewise in the form of activatable suction elements 56 (second suction elements). As shown in FIG. 10 and 12, the suction elements are each disposed spaced-apart in rows in groups of four, with three rows being provided on the second carriage 54. It is also possible for the lower row of suction elements 56 nearest to the plate cylinder 1 to be equipped with four suction elements 56 and for the other rows each to be provided with three. The suction elements 56 disposed in the lower row associated with the plate cylinder 1 are attached to levers 57, which are adapted to be swiveled about shafts 58. Pneumatic cylinders 59 are provided for the actuation of the levers 57. Furthermore, the levers 57 are subjected to the force of a spring 60. Disposed in the upper region of the magazine 4 is a preferably optical sensor 61, which monitors the position of the associated printing plate 9, particularly the position of the rear edge 41 thereof. Disposed between the upper and middle rows of suction elements is an activatable pressing-down device 62 for engagement of the printing plates 9. In addition, the magazine 4 comprises at its lower end a displaceable pressing-on element 63, which is in the form of a pressing-on roller 64 displaceable radially with respect to the plate cylinder 1.

The second carriage 54 is movable along a second guide 66 (FIG. 12) by means of a piston/cylinder unit 65. The second guide is formed by fixed profile rails 67, in which run guide rollers 68 of the carriage 54.

For the supplying of a printing plate 9, the lowermost suction elements 56, associated with the plate cylinder 1, may first of all come into operation, with the levers 57 being in their non-deflected positions. Thereafter, the suction elements 56 of the middle row of suckers and then the suction elements 56 of the upper row of suckers are activated. A different sequence, such as first the middle row and then the row at the edge, is conceivable. The non-simultaneous, but consecutive activation of the rows of suction elements ensures that the uppermost, new printing plate 9 is lifted in such a manner that no vacuum or only a very small vacuum is formed with respect to the further printing plate 9 below. This guarantees that only one printing plate 9 is lifted. As for the rest, the aforementioned spacers (plastic tabs) may be disposed between the individual printing plates 9, which additionally counteracts the formation of a vacuum. When the printing plate 9 has been lifted, the carriage 54 is pushed towards the plate cylinder 1 by means of the piston/cylinder unit 65. The front edge 44 of the printing plate 9 enters the front-edge clamping device 69 of the plate cylinder 1, which was appropriately positioned beforehand. During the above-depicted advance of the carriage 54, the angled printing-plate rear edge 41 slides through under the sensor 61, which registers the correct transport of the printing plate 9. During the transport of the carriage 54, a bypass in the air supply to the suckers of the suction elements 56 is activated, since a strong suction air is required only for the suction-gripping of the printing plate 9. After the carriage 54 has almost reached its outermost position facing the plate cylinder 1, the suckers of the lowermost and middle rows of suction elements 56 are rendered pressureless or are provided only with a weak vacuum; the printing plate 9 is therefore held only by the uppermost row of suckers. The purpose of this is so that the printing plate 9 can be better aligned. Subsequently, the front-edge clamping device 69 is closed, with the result that the front edge 44 of the printing plate 9 is firmly clamped. Next, the plate cylinder 1 rotates in the forward direction, pulling the printing plate 9 onto its outer cylindrical surface. Thanks to the bypass, the suction elements are provided only with a weak vacuum, with the result that they still hold the printing plate, but the printing plate can still be displaced on the suction elements through the rotation of the plate cylinder. Before the printing-plate rear edge passes the two upper rows of suckers, the latter are rendered pressureless and brackets 70 ensure that the angled rear edge slides past the suction elements without collision. Owing to its proximity to the plate cylinder 1, the printing plate 9 is relatively rigid in the region of the lower row of suction elements 56, with the result that, for the passage of the angled printing-plate rear edge 41, a lever 57, in the form of a plate with hinge and carrying the entire row of suckers, or a plurality of levers 57 are swivelled into their positions shown in FIG. 10 by means of one or more cylinders 59, with the result that the printing-plate rear edge 41 is able properly to pass the row of suckers. Subsequently, the pressing-on roller 64 is moved radially towards the plate cylinder 1, as a result of which the angled printing-plate rear edge 41 is pressed into the rear-edge clamping device 40 of the plate cylinder 1. The rear-edge clamping device 40 closes and then tensions the printing plate through appropriate displacement in the circumferential direction of the plate cylinder 1. Thereafter, the carriage 54 is moved back to its original position in order, at the appropriate time, to grip the next printing plate 9.

The device moves back into its starting position in that the cylinders 59 are rendered pressureless, with the result that the springs 60 are able to ensure that the lever(s) 57 return to their original positions. Subsequently, the pressing-down device 62 comes into action, ensuring that the remaining printing plates 9 remain properly in the cassette 8 and are unable to tip out, particularly when the magazine 4 is swiveled back into its vertical position.

FIG. 10 shows that the upper and middle rows of suction elements 56 are associated with elastic brackets 70. This, however, is necessary only for such stiff printing plates, the rear edges of which do not drop down as a result of their own weight. The elasticity of the brackets 70 permits the suction-gripping of the printing plate 9 that is to be used; that is, the brackets 70 do not disrupt this operation. As soon as the suction elements 56 no longer have any vacuum and, to that extent, the printing-plate rear edge 41 slides past the suction elements 56 during the supplying of the printing plate 9, the brackets 70 ensure that the angled printing-plate rear edge 41 does not catch on the suckers of the suction elements 56.

According to the invention, it is possible fully automatically to carry out a change of printing plates using the magazine 4 and/or to remove a used printing plate 10 and/or to supply a new printing plate 9. To be able to carry out a change of printing plates or the supply and/or removal of printing plates in the shortest possible time, it is provided, in a printing press provided with a plurality of printing units 2, that individual part-actions, such as, in particular, unclamping of the printing-plate rear edges 41 and/or unclamping of the printing-plate front edges 44 and/or removing of the used printing plates 10 and/or supplying of the yet to be used printing plates 9 and/or clamping of the printing-plate front edges 44 and/or pressing-down and clamping of the printing-plate rear edges 41, are effected consecutively, i.e. one after the other, as a function of the smallest positioning travel of the individual plate cylinders 1 on the corresponding printing units 2 before the next part-action is performed in similar manner. Work commences on that printing unit 2 which has the smallest positioning travel. Thereafter, the corresponding part-action is performed or further part-actions are performed until, in turn, there is a favorable short positioning travel on another printing unit 2, where the corresponding part-actions are then performed. These operations are repeated until the desired work has been carried out on all printing units 2 or on selected printing units 2.

Figure 20:
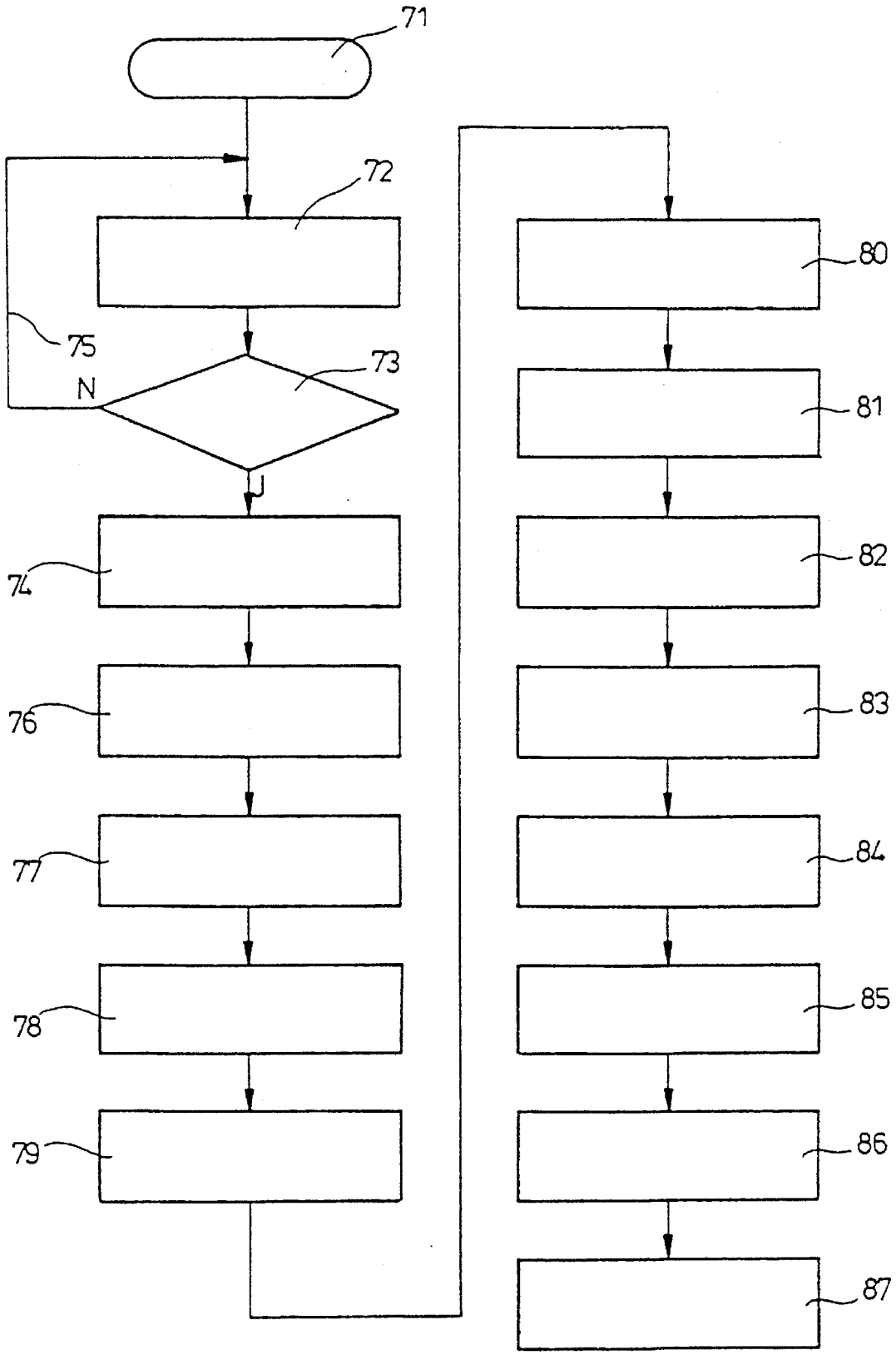
FIG. 20 shows a flow diagram for the fully automatic changing of printing plates.

In the case of the fully automatic changing of printing plates, the operator selects a suitable command from the control desk of the printing press 3. This is illustrated in the flow diagram in FIG. 20 by step 71. Subsequently, the relevant printing units 2 are selected and the function, i.e. the action to be performed, is specified. This is done at step 72. Thereafter, the operator actuates a start button on the control desk (step 73) and step 74 comes into action. If the operator wishes to perform a correction before actuating the start button, the loop 75 can be run through. After the start button has been actuated (step 73), the hereinbelow-described, following part-actions take place fully automatically. In step 74, all the selected printing units 2 are set to impression. In the following step 76, there is a positioning operation in order to remove a used printing plate 10 from that printing unit 2 which has the shortest positioning travel. It should be noted that the plate cylinders 1 of the individual printing units 2 are rigidly interconnected (through the intermediary of gearwheels etc), with the result that the rotation of one plate cylinder results in the corresponding rotation of all other plate cylinders. In step 77, the printing-plate rear edge 41 of the printing plate 10 is unclamped on the corresponding printing unit 2 (opening of the rear-edge clamping device 40). Subsequently, the respective plate cylinder 1 rotates backwards (step 78). This takes place until the plate-unclamping position is obtained on one of the other printing units 2. In step 79, said further printing-plate rear edge 41 is then unclamped. Steps 78 and 79 are repeated until the printing-plate rear edges 41 of all printing plates 10 have been unclamped. In step 80, there is then a backward rotation into the unclamping position of the printing-plate front edge 44 on the corresponding printing unit 2 requiring the smallest positioning travel. In step 81, the printing-plate front edge 44 is then unclamped through the automatic opening of the front-edge clamping device 69. These part-actions are repeated until all printing plates 10 have been unclamped. In step 82, the plate cylinders 1 are then rotated forwards until—in consideration of the smallest positioning travel—the first printing-plate front edge 44 of the new printing plates 9 comes into the insertion position. When this position has been assumed (step 83), clamping is performed there (also step 83). Part-actions 82 and 83 are repeated until all new printing plates 9 have been clamped at their front edges 44. In the following step 84, the plate cylinders 1 are rotated forwards until—once again in consideration of the smallest positioning travel—one of the printing-plate rear edges 41 of the printing plates 9 comes into a position for insertion into the respective rear-edge clamping device 40 of the corresponding plate cylinder 1. In step 85, the printing-plate rear edge 41 is then pressed down and clamped. These part-actions are repeated consecutively until all printing plates 9 have been clamped. In step 86, all printing units 2 are set electrically from impression. "From impression" means that the contacting cylinders are moved away from the plate cylinder. (To clamp the printing plates, they must be up against the plate cylinder in order to obtain proper contact.) In step 87, the plate cylinders 1 are rotated forwards, this being necessary in order to ensure that all the printing units 2 mechanically attain this operating position.

Figure 19:
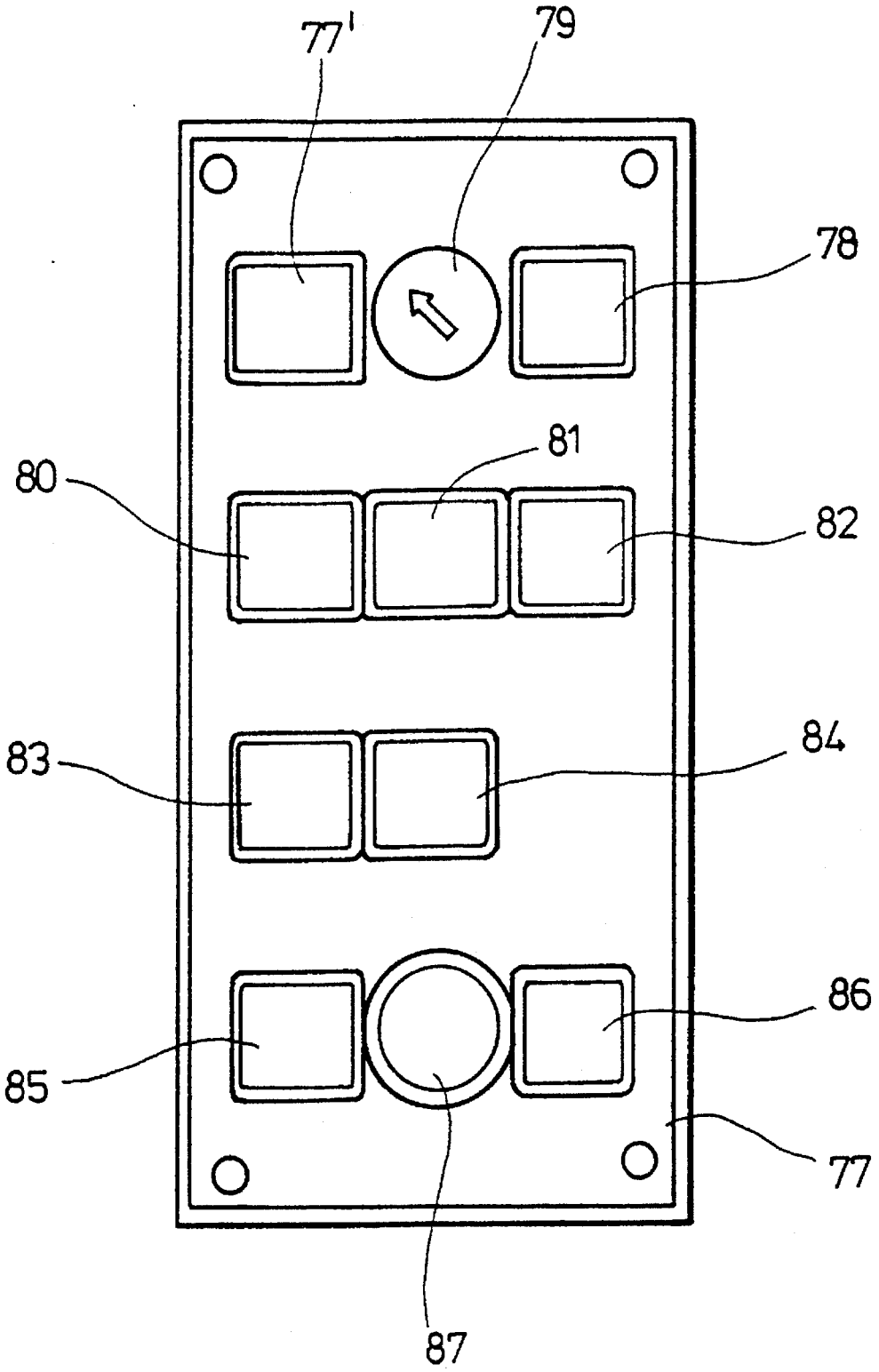
FIG. 19 shows a control panel on the respective printing units of the printing press.

However, the design according to the invention permits not only the fully automatic changing of printing plates, but also a semi-automatic operating mode. For this purpose, the operator actuates control elements of a control panel 77 on each printing unit 2 of the printing press 3. Said control panel 77 is shown in FIG. 19. There is a pushbutton 77' for "forwards" mode and a pushbutton 78 for "backwards" mode. In addition, there is a selector button 79 for "safety". An illuminated pushbutton 80 permits "plate inkers on/off" mode. In addition, there is a pushbutton 81 for "crawl speed" mode. An illuminated pushbutton 82 can be used for "ink vibrators on/off" mode. A pushbutton 83 is used for "positioning". An indicator light 84 indicates "fault: printing unit". In addition, there is an illuminated pushbutton 85 for "clamp/unclamp plate" mode and a further illuminated pushbutton 86 for "cancel changeover" mode. Finally, an "emergency stop" can be initiated using an emergency-stop switch 87.

In order to provide a good overview and to prevent operator errors, it is provided, in the case of semi-automatic changing of printing plates or removal or supply of printing plates, that different part-actions can be triggered consecutively using one and the same control element. If, therefore, a specific part-action is started with a control element, the execution of said part-action is registered by the printing press or by its control. If the same control element is then actuated once again at a later point in time, then a different part-action is executed. Consequently, only a few control elements are required and, moreover, the provision of a good overview largely prevents the operator from actuating the wrong control element by mistake.

The semi-automatic changing of printing plates is explained with reference to FIG. 21. "Semi-automatic" means that the operator merely actuates control elements, but does not himself handle the printing plate and/or actuate the clamping apparatus directly. Rather, operator control is always performed via the above-described control panel 77 (FIG. 19).

Figure 21:
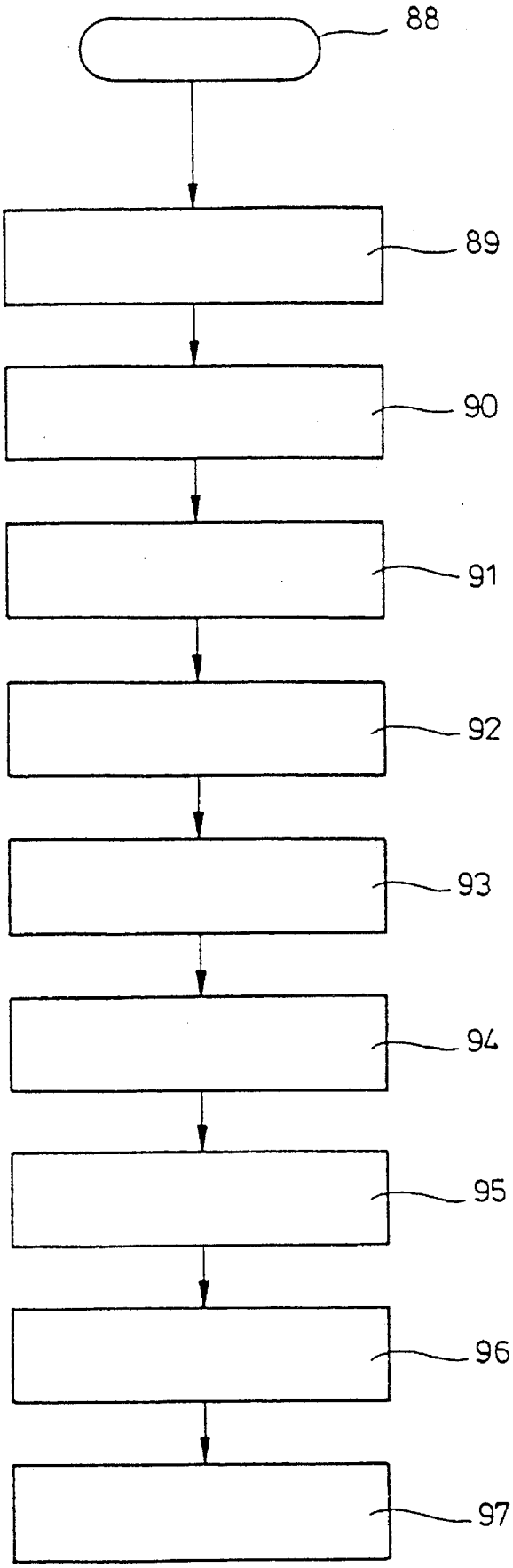
FIG. 21 shows a flow diagram for the semi-automatic changing of printing plates.

The semi-automatic changing of printing plates is started at step 88 of the flow diagram shown in FIG. 21. Then, in step 89, "safety" is activated through actuation of the selector button 79; that is, the printing-unit protective guard of the respective printing unit 2 opens. Then, in step 90, pushbutton 83 is actuated, as a result of which the plate cylinder is positioned to the end of the plate by the shortest route. Subsequently, in step 91, the illuminated pushbutton 85 is actuated by the operator, as a result of which the printing-plate rear edge 41 is unclamped. Then, in step 92, the "positioning" pushbutton 83 is pressed, as a result of which the plate cylinder 1 is rotated backwards as far as the start of the plate with automatic unclamping of the printing-plate front edge 44 when said position is reached. Then, in step 93, the illuminated pushbutton 85 is actuated, as a result of which the front edge 44 of a new printing plate 9 is clamped. In the following step 94, the printing unit is then set to impression and is moved forwards to the end of the plate. This is done by actuating the "positioning" pushbutton 83. At the same time, the rear-edge clamping device 40 of the respective plate cylinder 1 is opened and the printing-plate rear edge is pressed in with the pressing-on roller 64. Then, in step 95, the end of the printing plate (printing-plate rear edge 41) is clamped through actuation of the illuminated pushbutton 85. Then, in step 96, positioning is carried out through actuation of the pushbutton 83, as a result of which the plate cylinder of the next printing unit 2 is positioned to the corresponding end of the plate by the shortest route. Then, in the final step 97, the safety is taken off through actuation of the selector button 89.

Figure 22:
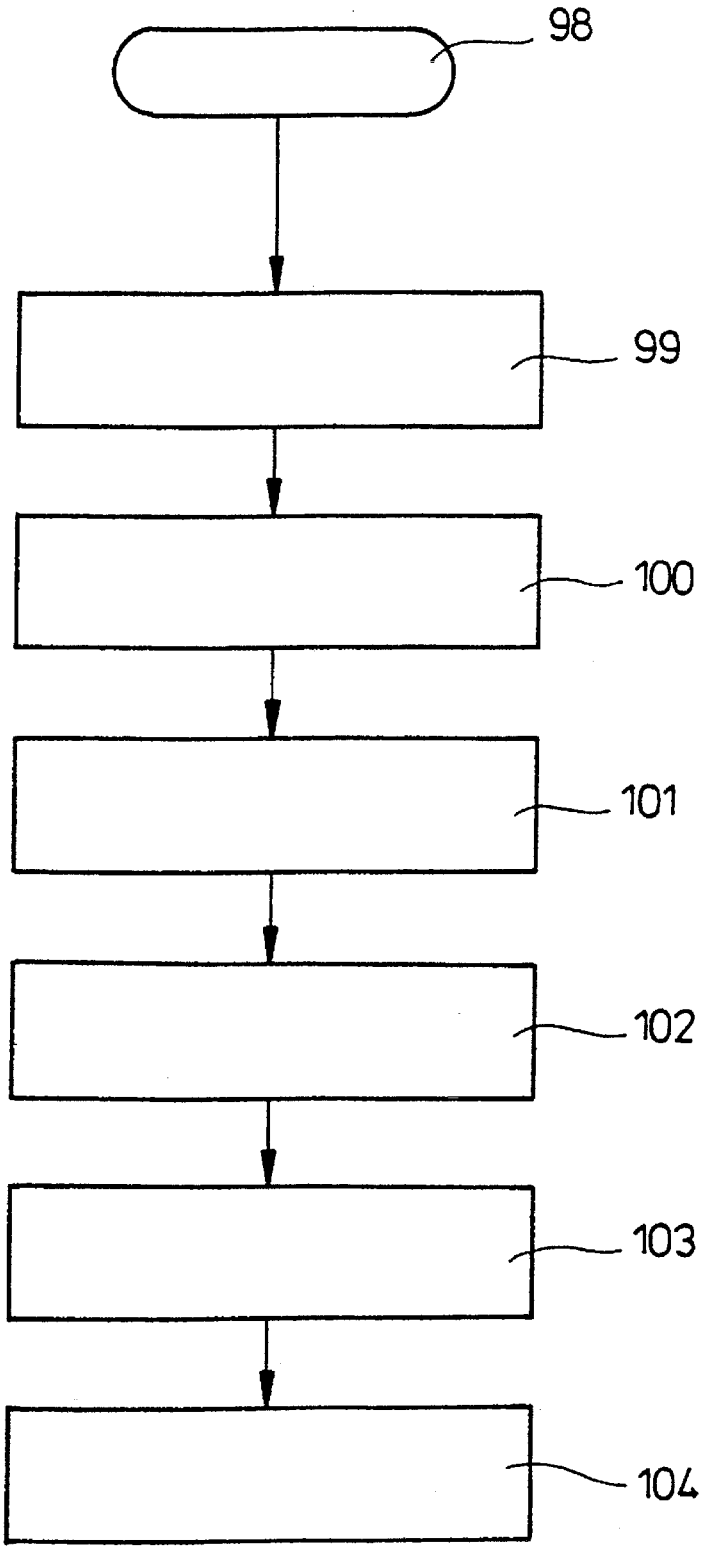
FIG. 22 shows a flow diagram for the semi-automatic removal of a printing plate.

The flow diagram shown in FIG. 22 describes the removal of a used printing plate 10. This function is started with step 98. In step 99, safety is activated through actuation of the selector button 79, as a result of which the printing-unit protective guard opens. Step 100 relates to positioning (pushbutton 83), as a result of which a move is made to the end of the plate by the shortest route. Subsequently, in step 101, the illuminated pushbutton 85 is actuated, as a result of which the printing-plate rear edge 41 is unclamped. In step 102, there is positioning (pushbutton 83) to the start of the plate through backward rotation of the respective plate cylinder 1 with automatic unclamping of the printing-plate front edge 44 when said position is reached. Then, in step 103, there is further positioning (pushbutton 83), with the result that a move is made, by the shortest route, to the end of the plate on the next printing unit 2. Then, in the final step 104, the safety is taken off (selector button 79).

Figure 23:
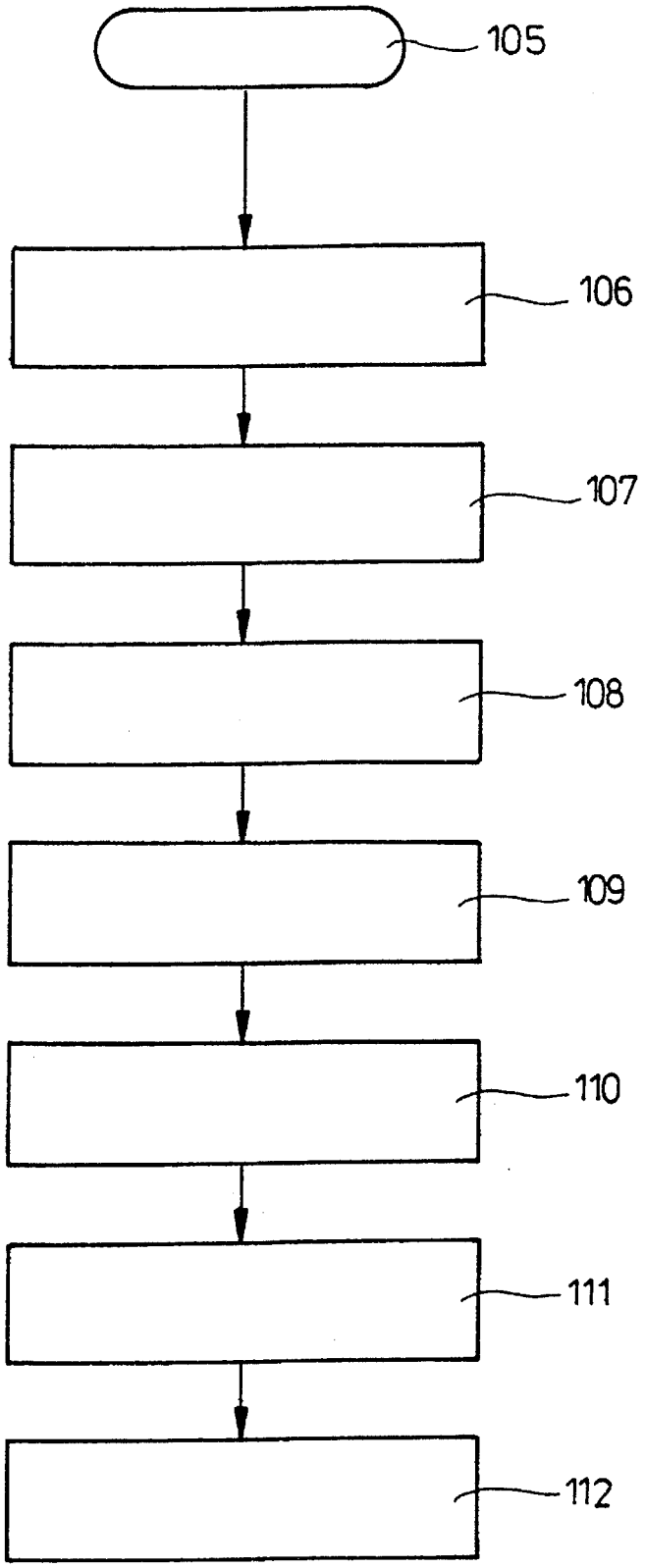
FIG. 23 shows a flow diagram for the semi-automatic supplying of a printing plate.

The flow diagram shown in FIG. 23 describes the clamping of a printing plate 9 in semi-automatic operating mode. This operating mode is started with step 105. In step 106, safety is activated through actuation of the selector button 79; the printing-unit protective guard opens. In the following step 107, there is positioning through actuation of the pushbutton 83; a rotation is made to the start of the printing plate by the shortest route. In the following step 108, the printing-plate front edge 44 is clamped through actuation of the illuminated pushbutton 85. Then, in the following step 109, the printing unit is set to impression and a forward rotation is made to the printing-plate rear edge 41 through actuation of the "positioning" pushbutton 83. In step 110, the rear edge of the plate is clamped through actuation of the illuminated pushbutton 85. Then, in step 111, a move is made to the start of the printing plate of the next printing unit 2 by "positioning" (pushbutton 83) by the shortest route. The safety is taken off in the final step 112 (selector button 79).

What is claimed is:

1. An apparatus for removing and delivering printing plates to or from a printing plate cylinder of a printing machine, comprising:

a magazine having an interior for receiving printing plates;

a plate removal device for removing a used printing plate from a printing plate cylinder and for placing the printing plate in said magazine and a plate delivery device for removing a new printing plate from the magazine and delivering the new printing plate to the printing plate cylinder; and at least one cassette removably received in said interior of said magazine, said at least one cassette being adapted to receive the used printing plate from said plate removal device, said at least one cassette for receiving the used printing plate having a bottom and adjoining, U-shaped upper and lower peripheral regions, said bottom and peripheral regions of said at least one cassette defining a space for receiving the used printing plate.

2. The apparatus according to claim 1, wherein said bottom and U-shaped peripheral regions define a receiving chamber for used printing plates, and said at least one cassette has a receiving chamber formed therein for printing plates to be delivered to the plate cylinder of the printing machine.

3. The apparatus according to claim 1, wherein said at least one cassette includes a first cassette and a second cassette, each of said first and second cassettes being removably associated with said magazine, said first cassette receiving used printing plates from said plate removal device and said second cassette housing new printing plates to be delivered to the printing plate cylinder.

4. The apparatus according to claim 3, wherein said second cassette includes a holding-down device, which acts upon the new printing plates to be delivered to the printing plate cylinder transversely relative to a plane thereof, to prevent the new printing plates from tipping out of said second cassette.

5. The apparatus according to claim 3, wherein said magazine has a layered structure including an outer, lower layer, an upper, outer layer and lower and upper intermediate layers disposed between said outer layers, said first cassette for receiving the used printing plates being disposed in said outer lower layer, said plate removal device associated with said first cassette being disposed in said lower intermediate layer, said second cassette for the new printing plates being disposed in said upper intermediate layer and said plate delivery device associated with said second cassette being disposed in said upper, outer layer.

6. The apparatus according to claim 1, wherein said magazine includes a receiving chute disposed at a receiving end thereof for facilitating an insertion of said cassette.

7. The apparatus according to claim 1, wherein said U-shaped upper and lower peripheral regions include respective legs forming retaining edges for the printing plates, said leg of one of said peripheral regions being longer than said leg of the other peripheral region.

8. The apparatus according to claim 1, wherein said cassettes carry colored identification codes corresponding to an associated printing mechanism and a color of an ink to be printed with the respective printing mechanism.

* * * * *